US006238463B1

(12) United States Patent
Helm

(10) Patent No.: US 6,238,463 B1
(45) Date of Patent: May 29, 2001

(54) PROCESS AND DEVICE FOR THE CLEANING OF EXHAUST AIR FROM KITCHEN EQUIPMENT

(75) Inventor: Peter Helm, Maisach (DE)

(73) Assignee: Eloma GmbH Grosskichentechnik, Maisach (DE)

( * ) Notice: Subject to any disclaimer, the term of this patent is extended or adjusted under 35 U.S.C. 154(b) by 0 days.

(21) Appl. No.: 09/374,787

(22) Filed: Aug. 16, 1999

(30) Foreign Application Priority Data

Aug. 17, 1998 (EP) ..... 98115452

(51) Int. Cl.[7] ..... B01D 47/02

(52) U.S. Cl. ..... 95/226; 55/DIG. 36; 96/343; 96/352

(58) Field of Search ..... 95/226; 96/329, 96/343, 344, 345, 351, 352, 353, 354; 55/DIG. 36

(56) References Cited

U.S. PATENT DOCUMENTS 2,405,494 * 8/1946 Dupuy ..... 96/345
4,182,617 * 1/1980 Al-Saidi ..... 96/352
5,141,538 * 8/1992 Derington et al. ..... 55/DIG. 36
5,358,540 10/1994 Tsan-Yun et al. .

FOREIGN PATENT DOCUMENTS

4338177 A1 5/1995 (DE) .
0852320 A1 7/1998 (EP) .
2281230 3/1995 (GB) .

* cited by examiner

*Primary Examiner*—Duane S. Smith
(74) *Attorney, Agent, or Firm*—Gardner, Carton & Douglas

(57) ABSTRACT

The present invention concerns a method of cleaning exhaust air from kitchen equipment, such as steamers, grilling equipment, baking ovens and the like. According to this method, the exhaust air is subjected to a pressure increase and then introduced into a fluid bath. The present invention also concerns a device (1) for cleaning exhaust air from kitchen equipment (3) for removing exhaust air from the kitchen equipment, having a pressure boosting device (7) for increasing the pressure in the exhaust air, a fluid bath (13) and an inlet line (9) for supplying exhaust air into the fluid bath (13).

16 Claims, 1 Drawing Sheet

PROCESS AND DEVICE FOR THE CLEANING OF EXHAUST AIR FROM KITCHEN EQUIPMENT

BACKGROUND OF THE INVENTION

The present invention concerns a method and a device for cleaning exhaust air from kitchen equipment, such as steamers, grilling equipment, baking ovens and the like. The term "cleaning" is also understood to refer to removing vapor from the exhaust air.

In operation of kitchen equipment, in particular steamers, hot air equipment, grilling equipment and baking ovens, exhaust air is generated, which can be a great burden on the ambient room air. The exhaust air contains hot water steam, smoke, fats, oils, noxious odors and other chemicals and compounds formed in burning fat.

To remove the exhaust air, for example by venting it to the outside, extremely expensive exhaust air installations and shafts are necessary and are also required by law, depending on the intended application of the kitchen equipment, which causes considerable extra costs for such kitchen equipment. In addition, it is known that removing the exhaust air to the outside causes a considerable odor burden in the immediate vicinity, which is why the use of such kitchen equipment is limited.

If no exhaust air system is provided, the room air may be greatly impaired by the exhaust air, so that certain cooking processes, such as smoking chickens in a hot air smoker, cannot be carried out reasonably at all.

Measures have already been proposed, but they have proven to be inadequate or uneconomical. For example, in one known method, the exhaust air is passed through a water mist. One disadvantage of this is the extremely high water consumption combined with the additional disadvantage that odors and smoke cannot be captured adequately. To improve this, activated carbon filters are also used, but they are very expensive and must be disposed of regularly as special waste.

Therefore, the object of the present invention is to create a method and a device for cleaning the exhaust air from kitchen equipment such as steamers, grilling equipment, baking ovens and the like, so that the exhaust air can be cleaned easily, effectively and inexpensively.

SUMMARY OF THE INVENTION

According to the present invention, the method is characterized in that the exhaust air is subjected to a pressure increase and then is introduced into a fluid bath. As a result, the exhaust air is cooled suddenly, vaporous components condense suddenly out of the exhaust air and oil and the oil and fat components of the exhaust air are collected. At the same time, the odoriferous substances are also collected in a fluid bath and at least some of the smoke particles are also bound. With the help of this simple measure, it is possible to effectively clean exhaust air from kitchen equipment.

Due to the fact that the exhaust air is introduced into the fluid bath through a filter, in particular a sintered metal filter, this advantageously achieves the result that the implosion noises produced by sudden condensation of the steam can be suppressed to a great extent. In addition, the filter also produces an initial cleaning effect.

Fresh fluid is advantageously supplied to the fluid bath either continuously or discontinuously and fluid is also removed from the bath. This prevents soiling of the fluid bath and permits long term operation of the kitchen equipment. In a first alternative, fresh fluid is supplied continuously to the fluid bath, thus permitting fluid exchange by a simple method.

As an alternative, the supply of fresh fluid may also be discontinuous. For example, the fluid supply may be made a function of the pressure increase, i.e., the fluid exchange in the fluid bath is increased when the supply of exhaust air increases. The term "discontinuous" is thus understood to refer not only to an interruption in time but also to a supply of different fluids.

It is also advantageous that the amount of thermal energy introduced into the fluid bath is at least partially dissipated again. This prevents the fluid bath itself from heating up too much, while in turn producing a fluid vaporization process.

Another advantage is that the cleaned exhaust air is discharged freely through an exhaust air discharge device by a simple method. The purified exhaust air is thus returned to the ambient air.

The present invention also concerns a device for cleaning exhaust air from kitchen equipment such as steamers, grilling equipment, baking ovens and the like. It has an exhaust air line for removing the exhaust air from the kitchen equipment, a pressure increasing device for increasing the pressure in the exhaust air, a fluid bath and an inlet line for introducing the exhaust air into the fluid bath.

This advantageously yields a simple and effective cleaning of the exhaust air from kitchen equipment, and only a few elements are needed to effectively perform this cleaning.

With the help of the pressure boosting device, it is possible to overcome the higher pressure created due to the liquid column of the fluid bath, whereby, depending on the embodiment, it is also possible to use the pressure boosting device as a device for venting the exhaust air out of the respective kitchen equipment, if said equipment does not have its own exhaust air venting device, dehumidifier device or the like.

At the outlet of the inlet line is a filter, in particular a sintered metal filter, so the noise generated when the exhaust air enters the fluid bath is greatly reduced. In addition, the filter precleans the air.

The fluid bath is preferably arranged in a container, in particular a closed container that has an overflow to form a fluid level. The amount of fluid in the container is limited with the help of the fluid level, and if there is too much fluid, it flows over the overflow.

The inlet line advantageously opens near the bottom of the container, so that exhaust air discharged there flows essentially through the entire height of the fluid bath.

In addition, the device according to the present invention advantageously has a heat dissipating device for dissipating heat introduced into the fluid bath by the exhaust air. This prevents the fluid bath from heating up too much and beginning to evaporate after a certain extent of exhaust air cleaning.

The heat dissipating device is preferably designed as a heat exchanger tube or so-called heat pipes. This not only permits effective dissipation of heat but also allows the use of standardized and thus inexpensive components.

Another advantage is that the pressure boosting device may be a compressor, such as a radial compressor, which also makes it possible to achieve a pressure increase in the exhaust air in a simple manner. With the help of this compressor, the exhaust air may also be actively exhausted from the kitchen equipment even in the case when the kitchen device does not have its own exhaust mechanism. In addition, a fresh air inlet device may also be provided with the pressure boosting device in the event that not enough exhaust air is available and the exhaust air is then mixed with fresh air and introduced into the fluid bath. This should prevent too much exhaust air from being vented from the kitchen equipment. Thus, the excellent cooking results achieved with this kitchen equipment is retained through the present invention.

According to the present invention, water is provided as the effective fluid means. It is especially advantageous to add a cleaning agent that produces little or no foam to the water, so that the capture of smoke particles in particular from the exhaust air can be greatly improved.

Due to the simple design of the device according to the present invention, it can be mounted directly on the kitchen equipment, utilizing the utility connections provided for the latter. This has several advantages. First, the design size is small accordingly and the line lengths are also reduced to a minimum. Additional exhaust air chutes from the kitchen space to the outside are thus superfluous due to the purified air.

BRIEF DESCRIPTION OF THE DRAWINGS

Additional details, features and advantages of the present invention are derived from the following description with reference to the drawing, which shows.

DETAILED DESCRIPTION OF THE INVENTION

Figure 1:
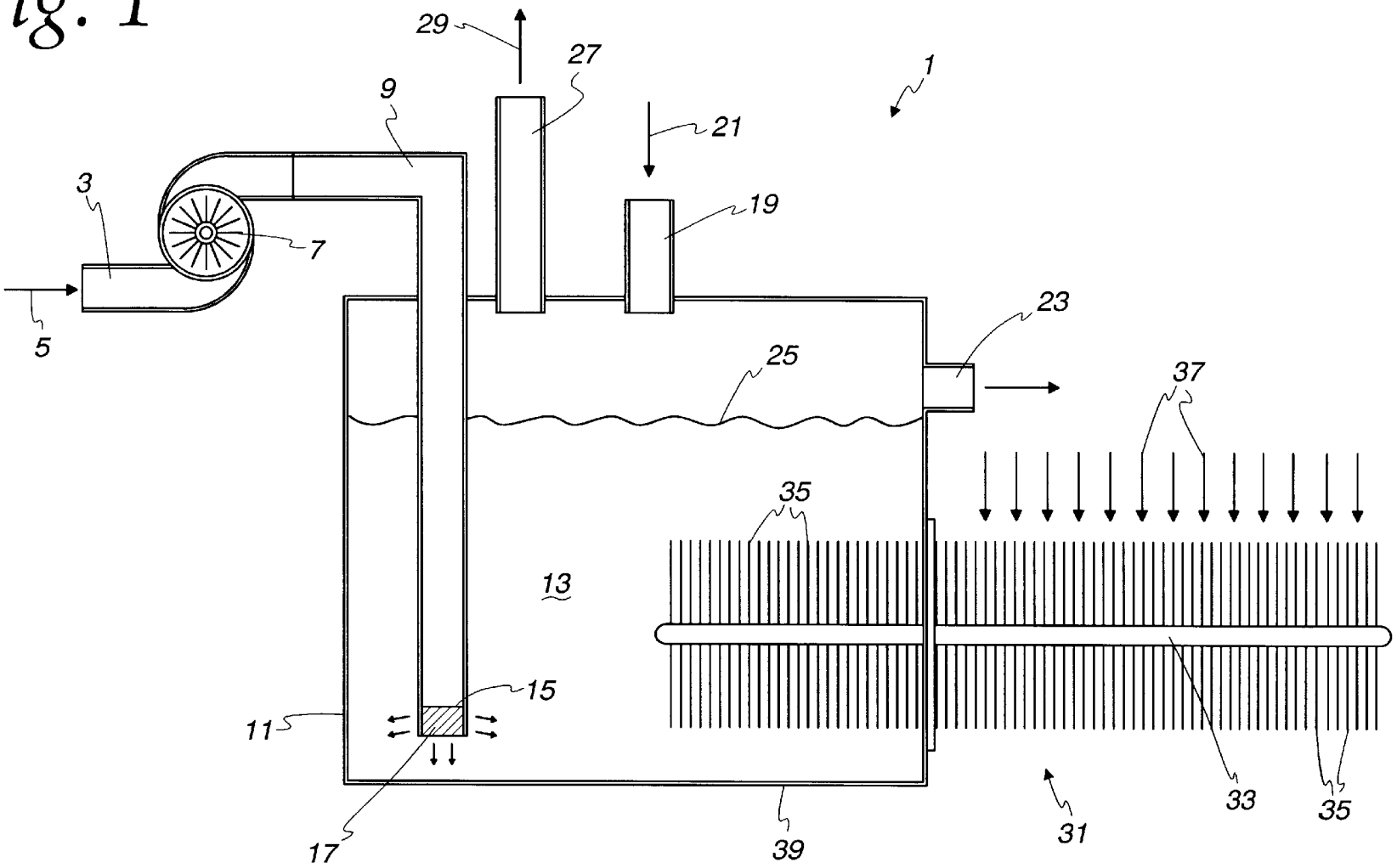
FIG. 1: the schematic design of a device according to the present invention for cleaning exhaust air from kitchen equipment.

FIG. 1 shows a schematic diagram of a device according to the present invention for cleaning exhaust air from kitchen equipment. In particular, the method according to the present invention for cleaning exhaust air from kitchen equipment can be carried out with this device.

The device 1 according to this invention has an exhaust air line 3 for removing the exhaust air from the kitchen equipment (not shown) according to arrow 5. A pressure boosting device 7 with the help of which the pressure in the exhaust air can be increased is provided in exhaust air line 3. The air is introduced into a container which holds a fluid bath 13 through an inlet line 9.

A filter 17 which is a sintered metal filter, for example, is arranged at the opening mouth 15 of the inlet line 9. The exhaust air passes through this filter to the outside into the fluid bath 13.

Fluid is introduced continuously or discontinuously into the fluid bath 13 through a fluid inlet canal 19, as indicated by arrow 21.

The fluid bath 13 is limited in the container 11 by the fact that a maximum filling level is formed in the fluid bath 13 in the form of a fluid level due to an overflow 23 provided at the side.

The exhaust air flows from the opening mouth 15 through the filter 17 into the fluid bath 13, rising upward, with the exhaust air being cleaned in its passage through the fluid bath. In addition, an outlet channel 27 for the cleaned exhaust air is also provided above fluid level 25, so the cleaned exhaust air then leaves the container 11 through the outlet channel 27 according to arrow 29.

The fluid bath 13 is heated by the hot exhaust air. To prevent the fluid bath 13 from overheating and to limit the heat rise to 60° C., for example, a heat dissipating device 31 is provided. In the embodiment shown here, the heat dissipating device is made of so-called heat pipes, including a heat exchanger tube 33 on which heat conducting plates 35 are arranged in parallel. The heat conducting plates 35 absorb heat and transfer it to the medium in the heat exchanger tube 33. Outside the container 11, ambient air flows past the heat conducting plates 35 according to arrows 37, cooling the heat conducting plates 35. In this way, excess heat is easily removed from the fluid bath 13.

The exhaust air may contain not only vapor but also smoke particles, fats and oils, which settle to the bottom of the fluid bath 13 in the container 11, so a drain device is provided for them in the form of the opening in the bottom plate 39 of the container 11, for example. If needed, the entire fluid bath 13 may also be drained out.

Thus, with the help of the present invention, the exhaust air from kitchen equipment can be cleaned effectively in a simple manner. Approx. 100% of the steam content of the exhaust air can be removed in a particularly advantageous manner.

However, the present invention is not limited to the embodiment presented here.

Thus, the container 11 and the fluid bath 13 may be designed with such large dimensions that inlet lines 9 from several kitchen devices open into one container 11. The inlet line 9 may also have multiple inlet channels with corresponding opening mouths, so that a large quantity of exhaust air can be introduced into the fluid bath 13 through multiple filters at the same time. The air flowing by according to arrows 37 may also be used elsewhere for heating. However, the heat dissipating device 31 may also be designed so that the heat dissipating side is itself standing in a container filled with a fluid such as fresh water, and this fresh water is heated up accordingly and then can in turn be reused as hot water.

What is claimed is:

1. A method of cleaning exhaust air from kitchen equipment comprising the steps of subjecting the exhaust air to a pressure increase, introducing the exhaust air into a fluid bath, and dissipating at least partially the thermal energy introduced into the fluid bath by the exhaust air.

2. The method according to claim 1, wherein the exhaust air is passed through a filter to introduce it into the fluid bath.

3. The method according to claim 1 wherein fresh fluid is added continuously or discontinuously to the fluid bath, and fluid is also removed from the fluid bath.

4. The method according to claim 1 wherein the exhaust air is passed through a sintered metal filter to introduce it into the fluid bath.

5. The method according to claim 1 wherein cleaned exhaust air is vented into the ambient environment through an exhaust air venting device.

6. A device for cleaning exhaust air from kitchen equipment comprising an exhaust air line for removing exhaust air from the kitchen equipment, a pressure boosting device for increasing the pressure in the exhaust air, a fluid bath and an inlet line for introducing the exhaust air into the fluid bath, and a heat dissipating device which is provided for removing the heat introduced into the fluid bath by the exhaust air.

7. The device according to claim 6 wherein the inlet line has a mouth opening in which a filter is arranged.

8. The device according to claim 6 wherein the fluid bath is arranged in a container having an overflow to form a fluid level.

9. The device according to claim 8 wherein the inlet line opens near the bottom of the container.

10. The device according to claim 6 dissipating device which is provided for removing the heat introduced into the fluid bath through wherein the inlet line has a mouth opening in which a sintered metal filter is arranged.

11. The device according to claim 6 wherein the heat dissipating device is a heat exchanger tube with heat conducting plates.

12. The device according to claim 6 wherein the pressure boosting device is a compressor.

13. The device according to claim 12 wherein the exhaust air can be actively vented from the kitchen equipment with the help of the compressor.

14. The device according to claim 6 wherein the fluid in the fluid bath is water.

15. The device according to claim 6 further comprising a cleaning agent that produces little or no foam which is added to the fluid.

16. The device according to claim 6 wherein the device is mounted directly on the kitchen equipment and uses the utility connection of the kitchen equipment.

* * * * *

UNITED STATES PATENT AND TRADEMARK OFFICE

CERTIFICATE OF CORRECTION

PATENT NO. : 6,238,463 B1
DATED : May 29, 2001
INVENTOR(S) : Helm

It is certified that error appears in the above-identified patent and that said Letters Patent is hereby corrected as shown below:

Column 4,
Line 66, delete "dissipating device which is provided for removing the heat introduced into the fluid bath through"

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*